US006378967B1

(12) United States Patent
Moser et al.

(10) Patent No.: US 6,378,967 B1
(45) Date of Patent: Apr. 30, 2002

(54) CLAMP-ON DRAWER SLIDE

(75) Inventors: Andreas Moser, Kernersville; Manfred Poer, Walkertown, both of NC (US)

(73) Assignee: Grass America, Inc., Kernersville, NC (US)

( * ) Notice: Subject to any disclaimer, the term of this patent is extended or adjusted under 35 U.S.C. 154(b) by 0 days.

(21) Appl. No.: 09/650,211

(22) Filed: Aug. 29, 2000

(51) Int. Cl.[7] ..... A47B 88/00
(52) U.S. Cl. ..... 312/334.1; 312/330.1
(58) Field of Search ..... 312/330.1, 334.1, 312/334.6, 334.14, 334.15, 348.1, 348.2; 403/283

(56) References Cited

U.S. PATENT DOCUMENTS

| | | | | |
|---|---|---|---|---|
| 3,067,882 A | | 12/1962 | Ribbens et al. | |
| 4,552,415 A | * | 11/1985 | Fulterer | 312/330.1 X |
| 4,842,351 A | | 6/1989 | Röck et al. | |
| 4,875,747 A | | 10/1989 | Hollenstein | |
| 5,090,786 A | | 2/1992 | Albiez et al. | |
| 5,370,454 A | | 12/1994 | Domenig | |
| 5,462,349 A | | 10/1995 | Grabher | |
| 5,556,183 A | | 9/1996 | Brüstle et al. | |
| 5,601,350 A | | 2/1997 | Röck et al. | |
| 5,641,216 A | * | 6/1997 | Grass | 312/334.27 |
| 5,681,101 A | | 10/1997 | Peter | |
| 6,244,679 B1 | * | 6/2001 | Robertson et al. | 312/334.1 |

FOREIGN PATENT DOCUMENTS

| | | | | |
|---|---|---|---|---|
| DE | 2143729 | * | 4/1973 | 312/330.1 |
| DE | 2202 312 | | 10/1973 | |
| DE | 27 02 217 A1 | | 7/1978 | |
| DE | 34 45 880 A1 | | 6/1986 | |
| EP | 0 520 539 B1 | | 8/1995 | |
| GB | 2 140 671 A | | 12/1984 | |
| GB | 2 196 835 A | | 5/1988 | |

* cited by examiner

*Primary Examiner*—Janet M. Wilkens
(74) *Attorney, Agent, or Firm*—John M. Harrington; Kilpatrick Stockton LLP

(57) ABSTRACT

A drawer slide is adapted to be fastened on a drawer side wall and has a somewhat Z-shaped profile. The drawer slide comprises an upper horizontal shank, a lower horizontal shank, a vertical shank located between and connecting the horizontal shanks, and at least one vertical flange attached to an edge of the lower horizontal shank opposite its connection to the vertical shank, wherein at least one vertical flange is attached to the lower horizontal shank after being produced as a preformed, separate member.

16 Claims, 2 Drawing Sheets

CLAMP-ON DRAWER SLIDE

FIELD OF THE INVENTION

The invention pertains to a drawer slide and a method of production thereof. The drawer slide is adapted to be fastened to a drawer side wall, and has a somewhat Z-shaped profile with an upper horizontal shank forming a guide slide, a lower horizontal shank carrying the drawer side wall, a vertical shank connecting the upper and lower horizontal shanks, and one or more vertical flanges spaced apart along an edge of the lower horizontal shank opposite the vertical shank. The vertical flanges secure the drawer slide to the drawer side wall.

BACKGROUND

Standard drawers are usually made from wood, particle board, or medium density fiberboard, and are preferably equipped with metal drawer slides, which provide a stable, durable, secure and smooth operation of the drawer.

Usually, drawer slides are securely screwed or doweled on the drawer bottom or drawer side walls. However, especially with the so-called quick assembly drawers, a screw connection between the drawer and drawer slide is not desirable because it is tedious, intricate and time consuming. Furthermore, such a system involves additional costs and expense of installation, including the necessary screws.

Drawer manufacturers have endeavored to simplify the drawer assembly process and to cut cost of manufacture and assembly. Some attempt have provided some improvements but the drawer slides of many drawers are still not satisfactorily secured to the drawer side wall in a simple and economic way. Accordingly, a need exists for a drawer slide which is less expensive to manufacture and install, and which may be securely fastened to a drawer side.

Steps toward solving the problem have involved drawer slides having a somewhat Z-shaped profile, so that the bottom of the drawer side wall comes into contact with a shank, and is fastened on it by suitable means. The Z-shaped drawer slides have the disadvantage of using more material compared to the earlier U-shaped slides, but are necessary in order to produce a secure connection between the drawer slide and the drawer. An example of one such attempt, providing many desired characteristics, is the drawer slide disclosed in U.S. Pat. No. 5,681,101 (the '101 patent). The '101 patent disclosed a drawer slide wherein vertical flanges ("holding devices") were produced along the lower horizontal shank of the slide by forming such flanges from material made available as a cut-out from material of the horizontal shank itself.

While the disclosed solution of the '101 patent provides many benefits, a different approach may be desirable in connection with certain aspects of the manufacturing of drawer slides. For example, in may be advantageous to attach vertical flanges, initially formed as separate pieces, to the lower horizontal shank of the drawer slide. Among other benefits, this method allows vertical flanges having specific desirable features to be more easily produced. For example, the dimensions of the vertical flanges may be altered to allow the manufacture of drawer slides to fit drawer slides of various thickness, without altering the manufactured dimensions of the main component of the drawer slide.

Accordingly, the task of the present invention is to provide a drawer slide of the previously mentioned type, having improved characteristics of manufacture, and which can be fastened securely to the drawer and, especially, the drawer side wall, and which still can be produced simply and efficiently.

SUMMARY OF THE INVENTION

The present invention provides a drawer slide which may be secured to a drawer side wall in a clamp-on fashion, and which is particularly efficient and economical in that it allows installation without the use of screws. The present invention also provides a vertical flange piece which is initially manufactured as a separate piece, providing greater flexibility in design and manufacture. The invention also provides a clamp-on drawer slide which is, overall, adapted to be more securely fastened to a drawer slide. A process for the manufacture of the drawer slide of the invention is also provided.

Accordingly, in one aspect the invention relates to a drawer slide adapted to be fastened on a drawer side wall and having a somewhat Z-shaped profile comprising, an upper horizontal shank, a lower horizontal shank, a vertical shank located between and connecting the horizontal shanks, and at least one vertical flange attached to an edge of the lower horizontal shank opposite its connection to the vertical shank, wherein the at least one vertical flange is attached to the lower horizontal shank after being produced as a preformed, separate member.

In another aspect, the invention relates to a drawer slide adapted to be fastened on a drawer side wall, and having a somewhat Z-shaped profile, comprising, an upper horizontal shank; a lower horizontal shank having at least one fastener aperture; a vertical shank located between and connecting the horizontal shanks; at least one cut-out tab formed in the vertical shank, which is formed as a substantially U-shaped cut in the vertical shank, and having a free end comprising at least one bent projection adapted to be pressed into the drawer side wall; and at least one vertical flange attached to an edge of the lower horizontal shank opposite the position of the at least one cut-out tab, and comprising a vertical member and a horizontal member connected along a common edge at substantially right angles to one another, wherein the vertical member comprises at least one bent projection adapted to be pressed into the drawer side wall; wherein the at least one vertical flange is attached to the lower horizontal shank after being produced as a preformed, separate member.

Although other drawer slides provide some advantages and convenience in regard to their manufacture, additional advantages are provided by the present invention. The present invention provides a convenient and efficient method of attaching a vertical flange, as described above, to a drawer slide profile. Because the vertical flange may be preformed as a separate member prior to attachment, it may be more easily produced in a configuration having advantageous properties as part of a holding fixture, including increased strength.

Accordingly, in yet another aspect, the invention relates to a process for producing a drawer slide, the process comprising forming a somewhat Z-shaped profile comprising an upper horizontal shank, a lower horizontal shank, and a vertical shank connecting the horizontal shanks; forming at least one vertical flange comprising a vertical member and a horizontal member connected along a common edge at substantially right angles to one another; and attaching the vertical flange to the lower horizontal shank by placing the horizontal member of the vertical flange under the lower horizontal shank and pressing an area of the overlapping horizontal member and the lower horizontal shank to form a depressed portion comprising a recess in an upper surface of the lower horizontal shank and a projection in the lower surface of the horizontal member, such that the vertical flange is secured to the lower horizontal shank by close contact of the material of the lower horizontal shank and the horizontal member in the depressed portion.

After the drawer side wall is placed on the lower horizontal shank of the drawer slide, the opposing cut-out tabs and the vertical flanges may be pressed towards one another such that projections of the cut-out tab and vertical flanges are forced into the side wall material, thereby anchoring the drawer slide to the side wall of the drawer. Further, the projections of the cut-out tab may be angle toward the opposing vertical flange, at an angle of up to 45 degrees, such that when the projections of the tab are pressed into the material of a drawer side, they tend to draw the drawer slide more tightly to the bottom of the drawer side wall.

One advantage of producing such a drawer slide is that the cut-out tabs of the vertical shank are formed directly out of the drawer slide material, which, from the point of view of production, is achieved simply. Another advantage of the present drawer slide is that the separate production of the vertical flange portion allows greater flexibility in the design of the flange, and in the manufacture of the drawer slide.

Usually two holding fixtures (a "holding fixture" comprises a cut-out tab and opposing vertical flange, together) per drawer slide are sufficient because the drawer side wall is additionally held down on the lower horizontal shank of the drawer slide by the projections of the cut-out tab and the vertical flange. However, more than two holding fixtures can be provided, if required.

Additional objects, advantages and novel features of the present invention will be set forth in part in the description which follows, and, in part, will become more apparent to those skilled in the art upon examination of the following or may be learned by practice of the invention.

DETAILED DESCRIPTION OF THE INVENTION

Figure 5:
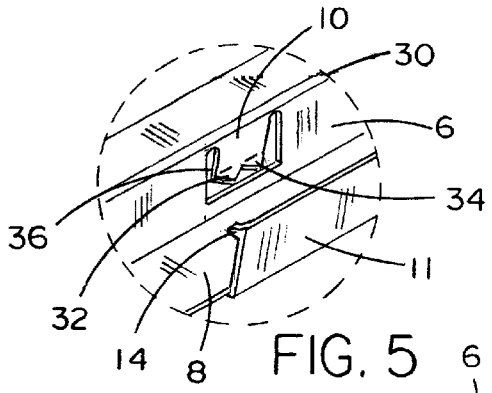
FIG. 5 is a partial enlarged view of one of the cut-out tabs of the vertical shank of the drawer slide of FIG. 1.

The present invention provides a drawer slide which may be secured to a drawer side wall in a clamp-on fashion, and which is particularly simple and economical to manufacture. The present invention provides a vertical flange which is initially manufactured as a separate piece, providing greater flexibility in design and manufacture, e.g. to accommodate drawer sides of various thickness with minimal manufacturing alterations. The invention also provides a clamp-on drawer slide which is, overall, adapted to be more securely fastened to a drawer side wall. A process for the manufacture of the drawer slide of the invention is also provided.

Accordingly, in one aspect the invention relates to a drawer slide adapted to be fastened on a drawer side wall, and having a somewhat Z-shaped profile, comprising, an upper horizontal shank, a lower horizontal shank, a vertical shank located between and connecting the horizontal shanks, and at least one vertical flange attached to an edge of the lower horizontal shank opposite its connection to the vertical shank, wherein the at least one vertical flange is attached to the lower horizontal shank after being produced as a preformed, separate member.

In a preferred embodiment, the drawer slide further comprises at least one projection formed in the vertical shank. More preferably, the at least one projection is positioned opposite the at least one vertical flange. Most preferably, the projection is angled obliquely downward toward the lower horizontal shank, and ends in a ledge-like projection forming a surface facing the lower horizontal shank.

In another preferred embodiment, the drawer slide further comprises at least one cut-out tab formed in the vertical shank. More preferably, the at least one cut-out tab is positioned opposite the at least one vertical flange. Also more preferably, the at least one cut-out tab formed in the vertical shank is bent out at an angle relative to the vertical shank in the direction of an opposing vertical flange. Also more preferably, the at least one cut-out tab has a free end with a bent projection adapted to be pressed into the drawer side wall. Also more preferably, the at least one cut-out tab formed on the vertical shank may be bent out at an angle up to 45 degrees relative to said vertical shank in the direction of the opposing vertical flange when the drawer slide is installed. More preferably, the free end of the at least one cut-out tab is directed toward the lower horizontal shank. Most preferably, the at least one cut-out tab in the vertical shank is formed as a substantially U-shaped cut in the vertical shank.

In another preferred embodiment, the at least one vertical flange further comprises a vertical member and a horizontal member joined along a common edge at an angle of substantially 90 degrees. More preferably, the vertical member of the at least one vertical flange further comprises a free end having at least one bent projection adapted to be pressed into the drawer side wall. More preferably, the at least one bent projection is directed toward the opposing vertical shank at an angle of substantially 90 degrees relative to the vertical member of the vertical flange. More preferably, the horizontal member of the at least one vertical flange is adapted to be connected to the lower horizontal shank. More preferably, the horizontal member is connected to the lower horizontal shank by at least one depressed portion which penetrates an area of overlapping material of both the horizontal member and the lower horizontal shank. Also more preferably, the connection between the horizontal member and the lower horizontal shank comprises two spaced apart depressed portions. Also more preferably, the two spaced apart depressed portions are substantially circular. Most preferably, the two spaced apart depressed portions are formed by pressing through the lower horizontal shank into the horizontal member such that recesses are produced in the upper surface of the lower horizontal shank, and corresponding projections are produced on the lower surface of the horizontal member, whereby the horizontal member and the lower horizontal shank are connected by material from each which is pressed into close contact in the area of the depressed portions.

In another aspect, the invention relates to a drawer slide adapted to be fastened on a drawer side wall, and having a somewhat Z-shaped profile, comprising, an upper horizontal shank; a lower horizontal shank having at least one fastener aperture; a vertical shank located between and connecting the horizontal shanks; at least one cut-out tab formed in the vertical shank, which is formed as a substantially U-shaped cut in the vertical shank, and having a free end comprising at least one bent projection adapted to be pressed into the drawer side wall; and at least one vertical flange attached to an edge of the lower horizontal shank opposite the position of the at least one cut-out tab, and comprising a vertical member and a horizontal member connected along a common edge at substantially right angles to one another, wherein the vertical member comprises at least one bent projection adapted to be pressed into the drawer side wall; wherein the at least one vertical flange is attached to the lower horizontal shank after being produced as a preformed, separate member.

In another aspect, the invention relates to a process for producing a drawer slide, the process comprising forming a somewhat Z-shaped profile which comprises an upper horizontal shank, a lower horizontal shank, and a vertical shank connecting the horizontal shanks; forming at least one vertical flange comprising a vertical member and a horizontal member connected along a common edge at substantially right angles to one another; and attaching the vertical flange to the lower horizontal shank by placing the horizontal member of the vertical flange under the lower horizontal shank and pressing an area of the overlapping horizontal member and the lower horizontal shank to form a depressed portion comprising a recess in an upper surface of the lower horizontal shank and a projection in the lower surface of the horizontal member, such that the vertical flange is secured to the lower horizontal shank by close contact of the material of the lower horizontal shank and the horizontal member in the depressed portion.

In a preferred embodiment, two spaced apart depressed portions are formed. Most preferably, the depressed portions are substantially circular.

Figure 1:
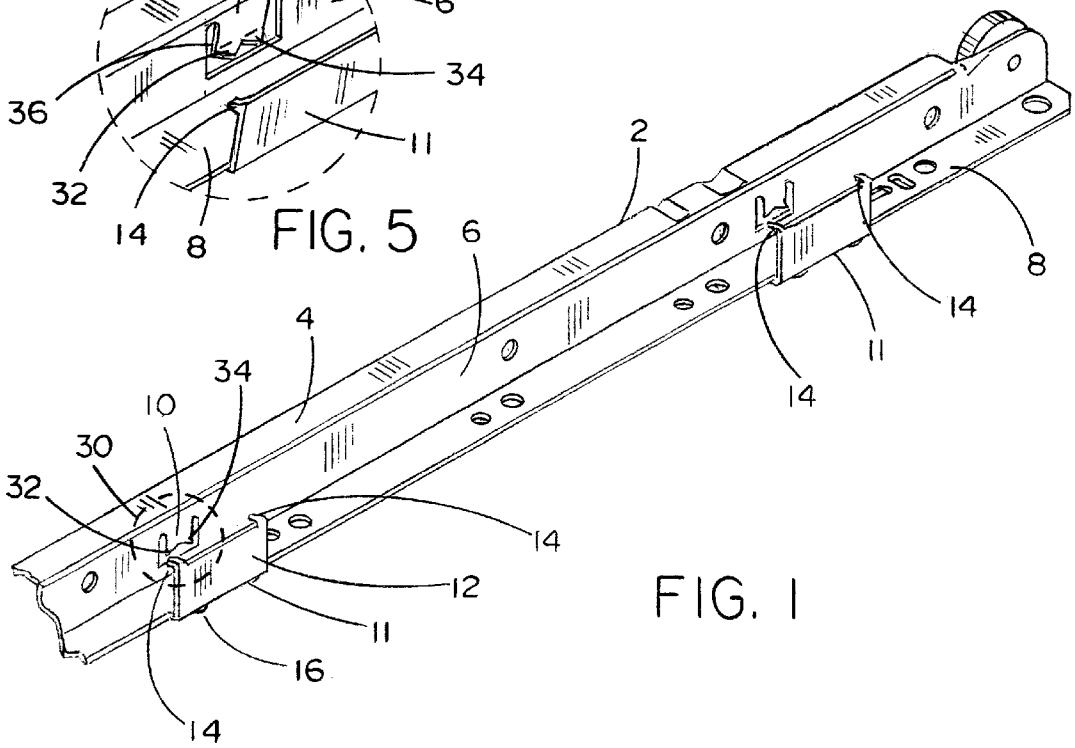
FIG. 1. is a side perspective view of one embodiment of the drawer slide of the invention.
Figure 2:
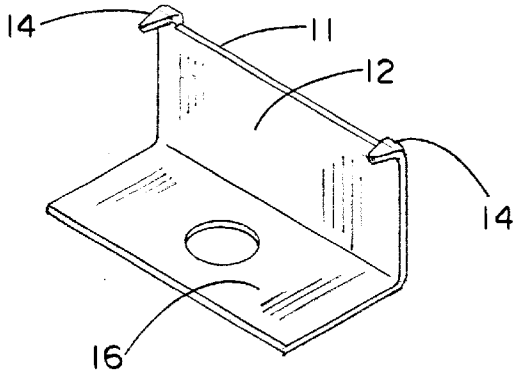
FIG. 2 is a perspective view of a vertical flange prior to attachment to the drawer slide.

Referring now to the Figures, in particular to FIG. 1, a side perspective view of one embodiment of the invention is shown. The drawer slide 2 comprises upper horizontal shank 4, vertical shank 6, and lower horizontal shank 8, to form an overall, generally Z-shaped profile in cross-section. Vertical shank 6 comprises at least one cut-out tab 10, the free end of which is disposed toward lower horizontal shank 8. Vertical flange 11 is attached to lower horizontal shank 8, and comprises vertical member 12 and horizontal member 16, connected along a common edge at substantially right angles to one another. As shown, the free end of vertical member 12 of vertical flange 11 further comprises projections 14, as shown in FIGS. 1 and 2. FIG. 2 is an enlarged view of vertical flange 11, before it is joined to lower horizontal shank 8. FIG. 2 also shows the projections 14 on the free end of vertical member 12, as well as horizontal member 16 which provides the base for attachment of vertical flange 11 to horizontal shank 8.

Cut-out tab 10 may be deflected toward the opposing vertical flange 11, as shown in FIG. 5, to secure the installation of the drawer slide 2 on a drawer side wall. Additionally, the free end of cut-out tab 10 may be characterized by projections 32, 34 similar to projections 14 of vertical flange 11. The projections 32, 34 may provide further security when cut-out tab 10 is deflected toward opposing vertical flange 11, and into the material of a drawer side wall (e.g. wood) on which drawer slide 2 is installed.

In an alternative embodiment, the cut-out tab 10 may be replaced by a projection which is stamped or pressed into the material of the vertical shank 6. Each projection 32, 34 is formed such that it extends outward from vertical shank 6 toward vertical flange 11, as shown in FIG. 5. The top of each projection 32, 34 is angled in this direction obliquely from vertical shank 6, and ends at the lower end in the form of a ledge 36 having a lower surface facing lower horizontal shank 8, as also shown in FIG. 5. Each projection 32, 34 is adapted such that when the drawer slide 2 is mounted on the drawer side wall, the lower surface or ledge 36 bites into the material of the drawer side wall, and helps prevent inadvertent removal of the drawer slide 2. As with cut-out tab 10, each projection 32, 34 may preferably be positioned opposite vertical flange 11.

Figure 3:
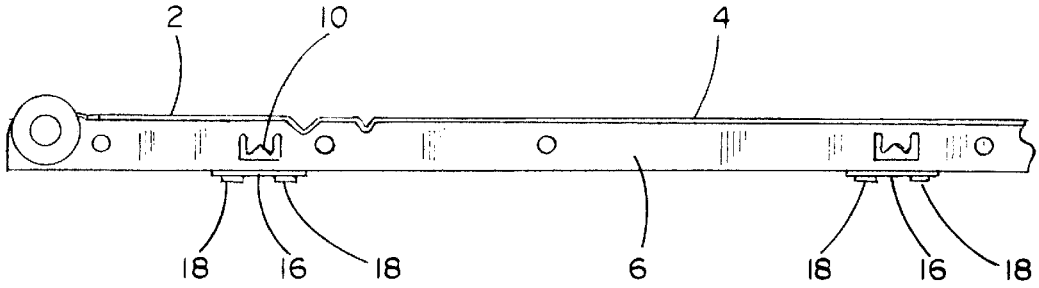
FIG. 3 is a side elevational view of the drawer slide of FIG. 1, showing the cut-out tabs of the vertical shank.

FIG. 3 shows a side elevational view of drawer slide 2, showing upper horizontal shank 4 and vertical shank 6. Cut-out tab 10 is shown in vertical shank 6. Also shown is the attachment of horizontal member 16 of vertical flange 11 to lower horizontal shank 8 via pressings resulting in joining projections 18. Joining projections 18 result when material derived from lower horizontal shank 8 and horizontal member 16 of vertical flange 11 are pressed together from above to form a connection securing the two together. An example of this type of connection that produced by the process of TOX® Pressotechnik GmbH, Weingarten, Germany. As indicated herein, use of this process for manufacture of the drawer slide of the invention represents an example of one aspect of the present invention.

Figure 4:
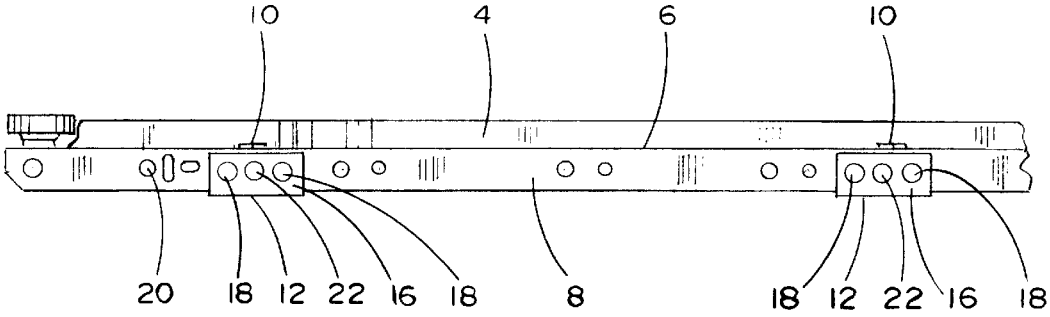
FIG. 4 is a bottom view of the drawer slide, showing the attachment of the vertical flanges to the lower horizontal shank.

FIG. 4 shows a bottom plan view of drawer slide 2, showing upper horizontal shank 4 and lower horizontal shank 8. Joining projections 18 formed from lower horizontal shank and the horizontal member 16 of vertical flange 11 are shown, as are apertures 22 through lower horizontal shank and the horizontal member 16 of vertical flange 11. Apertures 22 provide openings through which a fastener may be inserted, in order to provide additional security for the installation of drawer slide 2 on a drawer side wall. Additional apertures 20 (only one such aperture is labeled in FIG. 4 with a reference numeral, although others are shown) similarly provide openings for the insertion of additional fasteners or connectors requiring access to the material of the drawer side wall through the lower horizontal shank 8 of drawer slide 2.

Various preferred embodiments of the present invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the present invention. Accordingly, the invention is limited only by the following claims.

What is claimed is:

1. A drawer slide adapted to be fastened on a drawer side wall and having a somewhat Z-shaped profile comprising, an upper horizontal shank, a lower horizontal shank, a vertical shank located between and connecting the horizontal shanks;

at least one cut-out tab formed in the vertical shank, which is formed as a substantially U-shaped cut in the vertical shank, and having a free end extending toward the lower horizontal shank comprising at least one bent projection adapted to be pressed into the drawer side wall; and at least one vertical flange attached to an edge of the lower horizontal shank opposite the position of the at least one cut-out tab.

2. A drawer slide, according to claim 1, wherein the at least one projection is positioned opposite the at least one vertical flange.

3. A drawer slide, according to claim 1, wherein the at least one bent projection may be bent out at an angle up to 45 degrees relative to said vertical shank in the direction of the opposing vertical flange.

4. A drawer slide, according to claim 1, wherein the at least one vertical flange further comprises a vertical member and a horizontal member joined along a common edge at an angle of substantially 90 degrees.

5. A drawer slide, according to claim 4, wherein the vertical member of the at least one vertical flange further comprises a free end having at least one bent projection adapted to be pressed into the drawer side wall.

6. A drawer slide, according to claim 5, wherein the at least one bent projection is directed toward the opposing vertical shank at an angle of substantially 90 degrees relative to the vertical member of the vertical flange.

7. A drawer slide, according to claim 4, wherein the horizontal member of the at least one vertical flange is adapted to be connected to the lower horizontal shank.

8. A drawer slide, according to claim 7, wherein the horizontal member is connected to the lower horizontal shank by at least one depressed portion which penetrates an area of overlapping material of both the horizontal member and the lower horizontal shank.

9. A drawer slide, according to claim 8, wherein the connection between the horizontal member and the lower horizontal shank comprises two spaced apart depressed portions.

10. A drawer slide, according to claim 9, wherein the two spaced apart depressed portions are substantially circular.

11. A drawer slide, according to claim 10, wherein the two spaced apart depressed portions are formed by pressing through the lower horizontal shank into the horizontal member such that recesses are produced in the lower horizontal shank and corresponding projections are produced on the lower side of the horizontal member, whereby the horizontal member and the lower horizontal shank are connected by material from each which is pressed into close contact in the area of the depressed portions.

12. A drawer slide adapted to be fastened on a drawer side wall and having a somewhat Z-shaped profile, comprising:

an upper horizontal shank;

a lower horizontal shank;

a vertical shank located between and connecting the horizontal shanks;

at least one vertical flange attached to an edge of the lower horizontal shank opposite its connection to the vertical shank, wherein the at least one vertical flange is attached to the lower horizontal shank after being produced as a preformed, separate member; and at least one projection formed in the vertical shank, wherein the at least one projection is positioned opposite the at least one vertical flange, and wherein the projection is angled obliquely downward toward the lower horizontal shank, and ends in a projection forming a surface facing the lower horizontal shank.

13. A drawer slide adapted to be fastened on a drawer side wall and having a somewhat Z-shaped profile, comprising:

an upper horizontal shank;

a lower horizontal shank;

a vertical shank located between and connecting the horizontal shanks;

at least one vertical flange attached to an edge of the lower horizontal shank opposite its connection to the vertical shank, wherein the at least one vertical flange is attached to the lower horizontal shank after being produced as a preformed, separate member; and at least one cut-out tab formed in the vertical shank, wherein the at least one cut-out tab is positioned opposite the at least one vertical flange, and wherein the at least one cut-out tab formed in the vertical shank is bent out at an angle relative to the vertical shank in the direction of an opposing verticle flange.

14. A drawer slide adapted to be fastened on a drawer side wall and having a somewhat Z-shaped profile, comprising:

an upper horizontal shank;

a lower horizontal shank;

a vertical shank located between and connecting the horizontal shanks;

at least one vertical flange attached to an edge of the lower horizontal shank opposite its connection to the vertical shank, wherein the at least one vertical flange is attached to the lower horizontal shank after being produced as a preformed, separate member; and at least one cut-out tab formed in the vertical shank, wherein the free end of the at least one cut-out tab is directed toward the lower horizontal shank.

15. A drawer slide adapted to be fastened on a drawer side wall and having a somewhat Z-shaped profile, comprising:

an upper horizontal shank;

a lower horizontal shank;

a vertical shank located between and connecting the horizontal shanks;

at least one vertical flange attached to an edge of the lower horizontal shank opposite its connection to the vertical shank, wherein the at least one vertical flange is attached to the lower horizontal shank after being produced as a preformed, separate member; and at least one cut-out tab formed in the vertical shank, wherein the at least one cut-out tab in the vertical shank is formed as a substantially U-shaped cut in the vertical shank.

16. A drawer slide adapted to be fastened on a drawer side wall and having a somewhat Z-shaped profile comprising, an upper horizontal shank; a lower horizontal shank having at least one fastener aperture; a vertical shank located between and connecting the horizontal shanks; at least one cut-out tab formed in the vertical shank, which is formed as a substantially U-shaped cut in the vertical shank, and having a free end comprising at least one bent projection adapted to be pressed into the drawer side wall; and at least one vertical flange attached to an edge of the lower horizontal shank opposite the position of the at least one cut-out tab, and comprising a vertical member and a horizontal member connected along a common edge at substantially right angles to one another, wherein the vertical member comprises at least one bent projection adapted to be pressed into the drawer side wall; wherein the at least one vertical flange is attached to the lower horizontal shank after being produced as a preformed, separate member.

* * * * *